United States Patent [19]

Kenny

[11] 4,412,518

[45] Nov. 1, 1983

[54] IDLE SPEED CONTROL SYSTEM

[75] Inventor: Andrew A. Kenny, Roselle, Ill.

[73] Assignee: Eaton Corporation, Cleveland, Ohio

[21] Appl. No.: 322,806

[22] Filed: Nov. 18, 1981

[51] Int. Cl.[3] ..... F02B 77/00

[52] U.S. Cl. ..... 123/339; 123/338

[58] Field of Search ..... 123/339, 333, 338, 387, 123/198 D, 198 DB

[56] References Cited

U.S. PATENT DOCUMENTS

| | | | |
|---|---|---|---|
| 2,873,728 | 2/1959 | Blermann | 123/338 |
| 3,298,482 | 1/1967 | Mueller et al. | 192/3 |
| 3,329,135 | 7/1967 | Walker | 123/338 |
| 3,770,195 | 11/1973 | Franz | 236/13 |
| 4,038,958 | 8/1977 | Susuki | 123/339 |
| 4,105,002 | 8/1978 | Thoma | 123/339 |
| 4,205,639 | 6/1980 | Kawase et al. | 123/339 |
| 4,245,598 | 1/1981 | Ruhl | 123/339 |
| 4,328,697 | 5/1982 | Tumber et al. | 123/333 |
| 4,347,817 | 9/1982 | Muller | 123/333 |
| 4,355,606 | 10/1982 | Casey | 123/339 |
| 4,361,121 | 11/1982 | Clemens et al. | 123/333 |

*Primary Examiner*—Raymond A. Nelli

*Attorney, Agent, or Firm*—A. E. Chron; R. A. Johnston; C. H. Grace

[57] ABSTRACT

Disclosed is a system for maintaining the desired idling speed of an internal combustion engine. In its simplest form the system utilizes a speed biasing mechanism to regulate a source of fluid pressure supplied to a fluid pressure regulator to provide a first fluid pressure control signal therefrom that is proportional to changes in the rotational speed of the engine and is utilized to move a force member of an actuator device in such a manner as to maintain the engine idling speed. Alternative embodiments include combining the first fluid pressure signal in an integrator in the manner described with one or more additional fluid pressure signals derived from changes in other engine operating conditions to provide a control signal therefrom that is able to regulate a source of fluid pressure supplied to a regulator to provide the fluid pressure control signal for maintaining the engine idling speed.

19 Claims, 4 Drawing Figures

FIG. 2
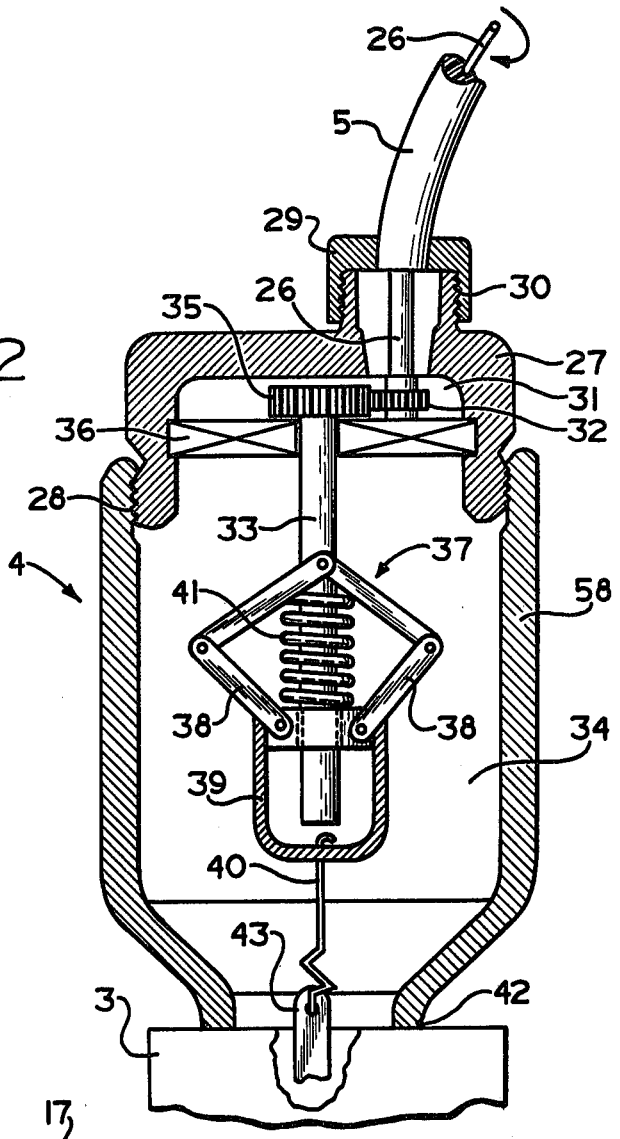
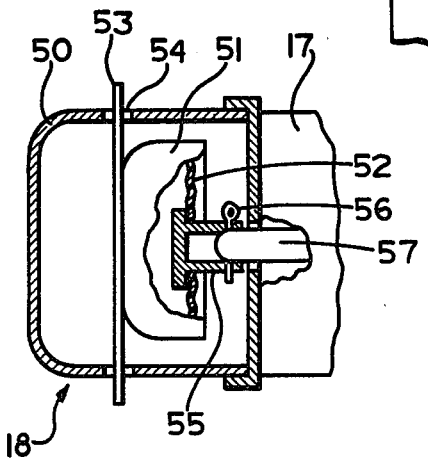
FIG. 4

IDLE SPEED CONTROL SYSTEM

INTRODUCTION

This invention relates generally to a fluid pressure system for maintaining the desired idling speed of an internal combustion engine and more particularly to a vacuum system that provides a fluid vacuum signal that is proportional to the rotational speed of the engine and is able to be used singularly or in combination with at least one additional fluid vacuum signal derived from an operative condition of the engine other than the rotational speed of the engine to provide a fluid vacuum output control signal that is conveyed to an actuator that in response to the control signal is able to maintain the desired engine idling speed.

CROSS REFERENCE

The subject matter of this application is related, in certain aspects, to that of U.S. Pat. No. 3,770,195; U.S. Pat. No. 3,298,482; my copending United States application Ser. No. 289,545, filed Aug. 3, 1981; and my copending United States application Ser. No. 309,286, filed Oct. 10, 1981.

BACKGROUND OF THE INVENTION

The use of a fluid pressure signal, particularly when in the form of a vacuum signal, has traditionally been a primary means of controlling various functions associated with internal combustion engines such as ignition timing, emission control, fuel flow and the like. Generally, the fluid pressure signal is provided by regulation of a fluid pressure regulator that is provided with fluid pressure (commonly a vacuum) from a source powered by the engine. Typically the regulated fluid pressure signal is provided by the movement of some type of valve associated with the regulator such that the movement thereof regulates the fluid pressure supplied to the regulator to provide the fluid pressure output signal.

Generally, it has been of interest in the past to monitor engine operating conditions such as changes in mass air flow through the engine or changes in the engine's coolant fluid temperature by some type of mechanism that is able to move a regulator valve to provide a regulated fluid pressure signal for accomplishing some desired function. An example of the use of a fluid pressure regulator that utilizes changes in temperature for providing a vacuum control signal for controlling the temperature of an automotive air conditioning system is disclosed in U.S. Pat. No. 3,770,195 and a barometric sensing fluid pressure regulator covering mechanisms for converting changes in barometric pressure into a fluid pressure control signal for controlling various emission control devices and engine operating parameters is disclosed in my copending United States patent application Ser. No. 309,286. An example of a governor in combination with an electromechanical device for use in a cruise control system for controlling the speed of an engine above a predetermined speed is disclosed in U.S. Pat. No. 3,298,482.

Although the previously described mechanisms have been individually used to advantage in the past to control various devices associated with internal combustion engines, particularly of the type used in motor vehicles, no one had thought up until the time of the present invention that changes in the rotational speed of the engine could be simply and effectively utilized to maintain a desired engine idling speed nor that the desired idling speed of the engine could be effectively maintained by use of a fluid pressure signal singularly or in combination with one or more fluid pressure signals that are proportional to changes in operating conditions of the engine other than its rotational speed such as, for example by the integrator mechanism for combining two or more fluid pressure signals to provide a single output fluid pressure signal disclosed in my copending United States patent application Ser. No. 289,545.

SUMMARY OF THE INVENTION

Accordingly, it is an object of this invention to provide an idle speed control system for use with an internal combustion engine that utilizes changes in the rotational speed of the engine as a parameter for maintaining a desired idling speed of the engine.

It is another object of this invention to provide an idling speed control system for use with an internal combustion engine that utilizes changes in the rotational speed of the engine in combination with changes in one or more additional operating conditions of the engine as a means for maintaining a desired idling speed of the engine.

DESCRIPTION OF THE DRAWINGS

FIG. 2 shows a longitudinal cross-sectional view taken through the embodiment of the engine speed biasing means referenced by numeral 4 as viewed in FIG. 1 and a partial broken away side view of the fluid pressure regulator embodiment referenced by numeral 3 as viewed in FIG. 1;

FIG. 4 shows a longitudinal cross-section taken through an embodiment of the atmospheric pressure sensing means referenced by numeral 18 as viewed in FIG. 1 and a partial broken away side view of the fluid pressure regulator referenced by numeral 17 as viewed in FIG. 1.

DETAILED DESCRIPTION OF PREFERRED EMBODIMENTS

Figure 1:
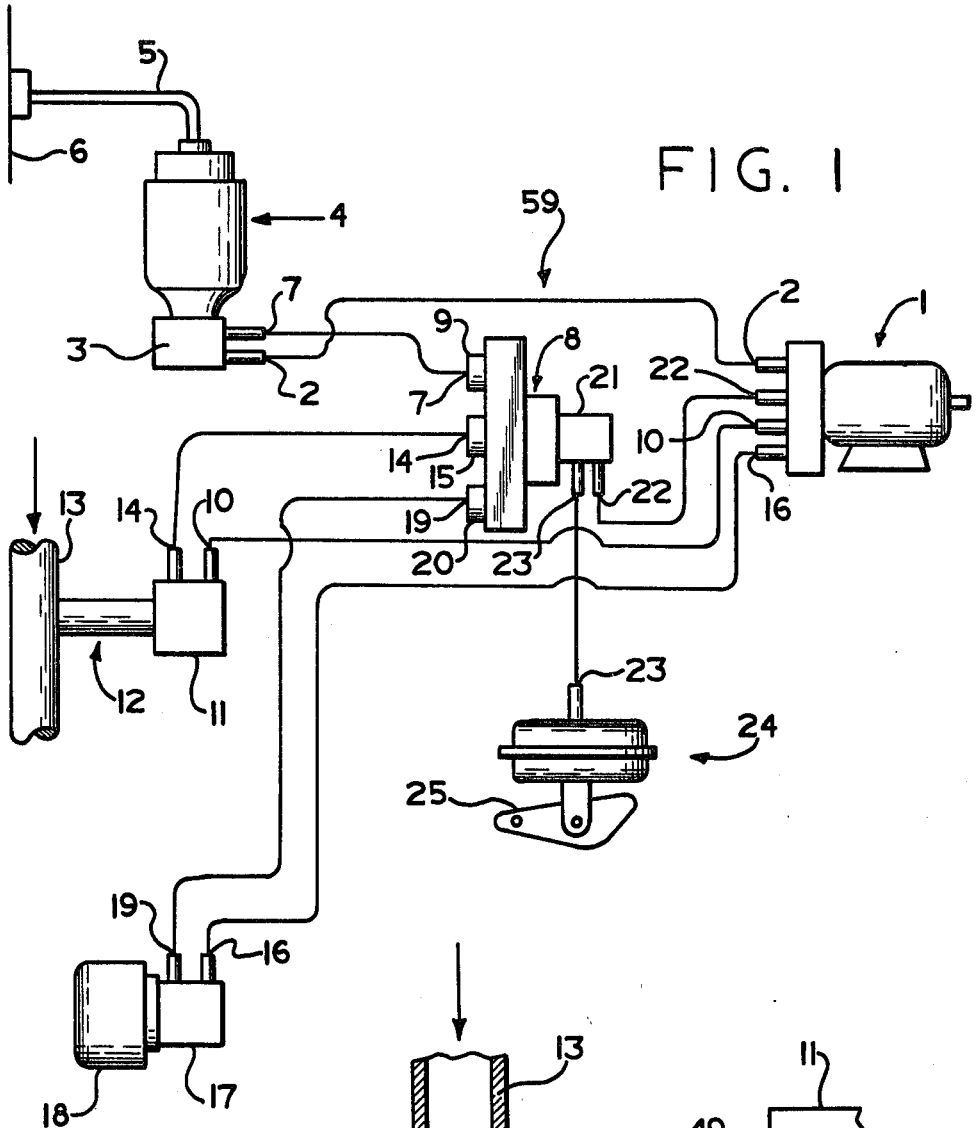
FIG. 1 shows a schematic view of the control system of the present invention.

FIG. 1 shows a schematic view of an embodiment of control system 59 of the invention. Although hereinafter described as a system that utilizes fluid pressure signals as a means of controlling the idling speed of an internal combustion engine, it is to be understood that the term "fluid pressure" as used herein means fluid pressure that is either below or above atmospheric pressure and thus includes a vacuum signal since, depending upon the type of pressure source and components used, the control system of the present invention although preferably using fluid vacuum signals as a means of control may also utilize fluid pressure signals that are above atmospheric pressure where applicable.

Shown in FIG. 1 is a fluid pressure supply means 1. Supply means 1 may be any suitable fluid pressure source such as an air compressor or a vacuum motor that is preferably driven by the internal combustion engine by suitable means such as a v-belt when the engine is running. An outlet port (not referenced) of supply means 1 is connected to an inlet port (not referenced) of fluid pressure regulator 3 by means such as a tube suitable to convey a fluid pressure supply 2 thereto. An outlet port (not referenced) of supply means 1 is also connected to an inlet port (not referenced) of fluid pressure regulator 11 by means such as a tube suitable to convey a fluid pressure supply 10 thereto. In one embodiment of the control system 59 of the invention, an outlet port (not referenced) is also connected by means such as a tube suitable to convey fluid pressure signal 16 to an inlet port (not referenced) of fluid pressure regulator 17. Regulator 17 is connected to atmospheric pressure sensing means 18 hereinafter described with respect to FIG. 3 having an outlet port (not referenced) connected to an inlet port (not referenced) of hereinafter described integrator 8 by suitable means such as a tube for the conveyance of a regulated pressure responsive fluid pressure input signal 19 thereto. Sensing means 18 and the circuitry connecting regulator 17 to supply means 1 and integrator 8 are an alternative embodiment of control system 59 with the preferred embodiment being the hereinafter described component shown in FIG. 1.

Engine speed biasing means 4 is connected to fluid pressure regulator 3 which, as previously described, receives fluid pressure supply 2 from supply means 1. Biasing means 4 may be any type of device that is able to convert the rotational speed of the engine into an output signal that is able to be utilized by regulator 3 to provide a regulated first fluid pressure output signal 7 therefrom that is proportional to the rotational speed of the engine. In the preferred embodiment of the control speed of the invention, biasing means 4, as hereinafter described with respect to FIG. 2, has a rotatable member that is rotated by Cable 5 that has means 6 for monitoring the rotational speed of the engine at a suitable point and has a centrifugal weight assembly secured thereto having at least one component thereof that is able to move a moveable member of regulator 3 so as to regulate fluid supply pressure 2 to provide fluid pressure output signal 7 proportional to the rotational speed of the engine.

Coolant fluid temperature sensing means 12 is connected to fluid pressure regulator 11 which, as previously described, receives fluid pressure supply 10 from supply means 1. Sensing means 12 is connected to a suitable conduit or chamber such as pipe 13 which enables the coolant temperature to be sensed in the manner desired. Sensing means 12 may be any device which is able to suitably sense the temperture of the coolant and convert changes in the coolant temperature into a control signal that is able to be utilized by regulator 11 to regulate fluid supply pressure 2 to provide a regulated additional fluid pressure output signal that is proportional to the change in the coolant temperature. One such device is shown in greater detail in FIG. 3.

First fluid pressure signal 7 and additional fluid pressure signal 14 are conveyed by suitable means such as a tube to inlet ports 9 and 15 of integration means 8 and as such become the first and additional fluid pressure signals received by integrator 8. Integrator 8 has a plurality of inlet ports of which only three are used in the embodiment of system 59 shown in FIG. 1. Integrator 8 is able to combine the first and one or more additional fluid pressure signals in the manner desired to provide a single control signal therefrom that represents the desired combination of the first fluid pressure input and one or more additional fluid pressure input signals thereto. Integrator 8 sums a plurality of vacuum input signals by means of a rotating member thereof as disclosed in my copending United States patent application Ser. No. 289,545.

Integrator 8 is connected to fluid pressure regulation means 21 which is connected to supply means 1 by suitable means such as a tube so that fluid supply pressure 22 can be conveyed thereto from supply means 1. Regulator 21 has a moveable member that is caused to be moved by the control signal such that it regulates fluid supply pressure 22 to provide fluid pressure control signal 23. Control signal 23 is conveyed from an outlet port of regulator 21 by suitable means such as a tube of an outlet port of idle speed actuator 24 having force member 25 associated therewith. Actuator 24 may be any device having means for moving force member 25 proportionately to the fluid pressure control signal 23 received thereby such as, for example, by signal 23 exerting a force on a pressure sealed side of a flexible diaphragm such that the movement thereof as a result of the force is able to cause a proportional movement of force member 25 on the non-pressure sealed side thereof. Force member 25 is positioned such that the movement thereof is able to maintain the desired engine idling speed. Although force member 25 may have any suitable shape, it preferably is in the form of a cam that by the movement of member 25 is able to bias the engine throttle in such a direction as to maintain the desired engine idling speed.

Thus, the control system of the invention utilizes a speed biasing device that is able to regulate a fluid pressure regulator in response to changes in the rotational speed of the engine in such a manner as to provide a first fluid pressure signal that is able to be used singularly or in combination with one or more additional fluid pressure input signals derived from one or more other engine operating conditions such as, for example, the fluid pressure signal derived from coolant fluid temperature sensing means 12, to control the idling speed of an internal combustion engine. In cases where one or more of the additional fluid pressure signals are used, the first and additional fluid pressure signals are conveyed as fluid pressure input signals to an integrator which is able to combine the input signals in the manner desired to provide an output control signal that is able to regulate a fluid pressure supply to provide a proportionate fluid pressure control signal that is able to be utilized by an idle speed actuator to move a force member that is able to maintain the engine idling speed by moving proportionately in response to a change in the engine rotational speed and in the one or more engine operating conditions.

FIG. 1 also shows an embodiment of control system 59 of the invention that utilizes an atmospheric pressure sensing means 18 either in combination with engine speed biasing means 4 or in combination with both engine speed biasing means 4 and coolant fluid temperature sensing means 12. The addition of pressure sensing means 18 is illustrative of the fact that embodiments of the control system of the invention include those which combine at least one additional engine operating condition sensing means with engine speed biasing means 4. Pressure sensing means 18 provides a control signal in response to changes in the barometric pressure which can be utilized to cause a moveable member of fluid pressure regulator to provice a pressure responsive fluid pressure output signal therefrom that is proportional to the barometric pressure. Changes in barometric pressure can arise from either or both changes in the weight of the atmosphere at a given location or changes in elevation of the engine. An example of an atmospheric pressure sensing device suitable for use in control system 59 is disclosed in my copending United States patent application Ser. No. 309,286 of which an embodiment thereof is shown in FIG. 4.

Pressure sensing means 18 is connected to fluid pressure regulator 17 which is connected by suitable means such as a tube to supply means 1 for the conveyance of fluid pressure supply 16 thereto and which has a moveable member that is able to be moved by pressure sensing means 18 to regulate fluid pessure supply 16 to provide a fluid pressure output signal 19 therefrom that is conveyed by suitable means such as a tube to inlet port 20 of integrator 8 to become an additional fluid pressure input signal thereto that is proportioned to the change in barometric pressure to which the engine is exposed. Thus, depending upon which additional engine operating parameters are sensed, the control system of the present invention is able to combine such additional fluid pressure signal or signals in the manner desired with the first fluid pressure input signal derived from the engine speed biasing means providing an output control signal proportional to the combination of such fluid pressure input signals for maintaining the engine idling speed.

Any fluid pressure regulation means may be used having a moveable member as herein described with respect to fluid pressure regulators 3, 11, 17 and 21 that is able to suitably regulate fluid pressure supplied thereto in the manner required by the control system of the present invention. One type of fluid pressure regulator disclosed in U.S. Pat. No. 3,770,195, the disclosure of which is incorporated herein by reference, has been found to be of advantage in the control system of the invention in which the fluid pressure is less than atmospheric (vacuum). In such regulator the moveable member is in the form of a vent member that is moveably disposed in a cavity within the regulator. The vent member is secured within the cavity to a resilient diaphragm that is sealingly engaged about its periphery with the housing wall enclosing the cavity to provide a vacuum chamber on one side of the diaphragm. The housing has an inlet port for receiving a source of vacuum into the vacuum chamber and an outlet port for conveying the regulated vacuum signal therefrom. An orifice is disposed between the inlet and outlet ports and an open ended channel extends through the vent member to provide a vent through the diaphragm between the cavity and the vacuum chamber. A dumbbell shaped valve is disposed between the vent member and the vacuum chamber orifice in such a manner that the valve is able to increase the vacuum in the vacuum chamber by opening the orifice and sealing the vent member channel when the vent member is moved in one direction and to seal the orifice and open the vent member channel to reduce the vacuum in the chamber when the vent member is moved in the opposite direction with the diaphragm providing a counterbalancing force tending to appose the movement of the vent member.

Although alternative embodiments of the idling speed control system of the present invention utilize a fluid pressure signal derived from a speed biasing device regulator mechanism described herein in combination with one or more fluid pressure signals such as the pressure responsive signal and coolant fluid temperature described herein, in its simplest form the control system of the invention utilizes only the fluid pressure signal derived from a speed biasing mechanism for controlling the idling speed of an engine. In such case, the fluid output pressure signal 7 would be conveyed directly to actuator 24 and would be the fluid pressure control signal for causing force member 25 to move in response thereto to maintain the idling speed of the engine and as such the singular use of an engine speed biasing means in a system for maintaining a desired engine idling speed is considered within the scope of the invention.

FIG. 2 shows a longitudinal cross-sectional view of one type of engine speed biasing means 4 that can be used to advantage in the control system of the invention. Biasing means 4 comprises a support in the form of an open-ended housing defined by walls 58 having a cavity 34 therewithin that communicates with the open ends of the housing. Cap 27 having open space 31 therewithin is threadingly engaged with walls 58 by threads 28. Rotatable means 36 such as bearings are secured to the wall of cap 27 within space 31 in such a manner as to rotatably support shaft 33 vertically in cavity 34. Although any suitable means may be used to rotate shaft 33 at a speed that is proportional to the rotational speed of the engine, the embodiment of biasing means 24 shown in FIG. 2 uses a rotatable means disposed on shaft 33 in the form of gear 35 that is adapted to engage with gear 32 which is rotated by cable 26 that enters through an opening in the top of cap 27 into space 31. Cable 26 is caused to rotate by a means disposed at the opposite end of cable 26 (not shown) that is able to monitor the rotational speed of the engine at a convenient location. Although cable 26 may be simply a cable, it is preferred that cable 26 rotate within an outer protective jacket 5 that is secured against movement with respect to the housing such as, for example, by nut 29 that is threadingly engaged to cap 27 by means of threads 30. Although it is preferred that the engine speed biasing means used with the control system of the invention have a vertically rotating member such as shaft 33, it is to be understood that versions in which shaft 33 is not vertical or in which the rotating member is not a shaft but for example, a drum, are considered within the scope of this invention.

Centrifugal weight assembly 37 is secured to shaft 33 and able to rotate therewith within cavity 34. Assembly 37 has components 38 thereof that are caused to move upwardly along shaft 33 when the rotational speed thereof is increasing and downwardly therealong when the rotational speed thereof is decreasing as a result of the effect of changes in the centrifugal force upon assembly 37 arising from the respective increase and decrease in the rotational speed thereof. Coupling member 39 is connected to components 38 and is moveably engaged with shaft 33 such that coupling member 29 is correspondingly moved upwardly and downwardly along shaft 33 in response respectively to increases and decreases in the rotational speed of shaft 33. Walls 58 of the housing are secured to fluid pressure regulator 3 by means of threads 42. Linking member 40 connects coupling member 39 to the previously described moveable member 40 of regulator 3 through the lower opening in the housing. Preferably, a resilient means such as coiled wire 41 is supported from assembly 37 and against coupling member 39 in such a manner as to dampen the movement of coupling member 39 downwardly along shaft 33 and bias the movement thereof upwardly along shaft 33 without interferring with the rotation of assembly 37. Cable 26 is thus able to rotate shaft 33 and centrifugal weight assembly 37 at a speed that is proportional to the rotational speed of the engine which in turn causes coupling member 39 to provide a control signal that moves linking member 40 upwardly and downwardly depending on where the rotational speed of the engine is increasing or decreasing which in turn moves moveable member 43 of regulator 3 to proportionally regulate fluid pressure supply 2 to provide regulated first fluid pressure signal 7 therefrom. The engine speed biasing means of FIG. 2 can be calibrated by turning cap 27 so as to move shaft 33, assembly 38, coupling member 39, linking member 40 and moveable member 43 upwardly or downwardly in order to position moveable member 3 in the manner desired for a particular engine rotational speed. Although coupling member 39 is moveably engaged with shaft 33 by two components 38 in FIG. 2, only one such component may be utilized when suitable and coupling member 39 need not be moveably engaged with shaft 33 but may be suspended in cavity 34 below the end of shaft 33 or moveably mounted by other suitable means. The embodiment of biasing means 4 shown in FIG. 4 is particularized in great detail for illustrative purposes only, it being understood that any mechanism using any type of support that is able to convert a change in the rotatable movement of a body member that is rotating proportional to the engine rotational speed into an output signal that is able to be utilized by a fluid pressure regulator associated therewith in a manner that provides the desired proportionately regulated fluid pressure output signal therefrom is considered within the scope of the invention.

Figure 3:
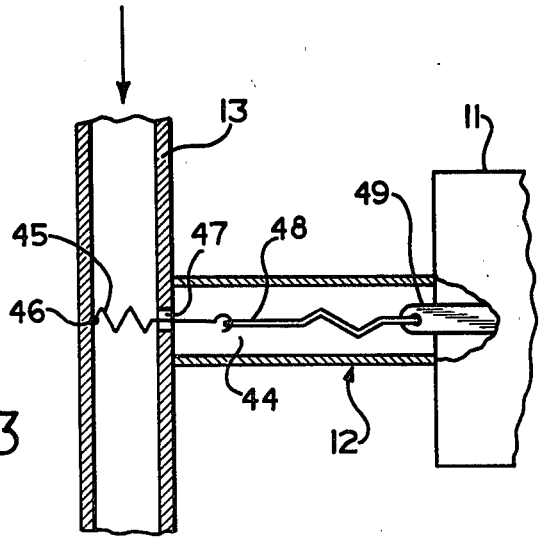
FIG. 3 shows a longitudinal cross-sectional view taken through the embodiment of the coolant temperature sensing means and coolant fluid pipe referenced respectively by numerals 12 and 13 as viewed in FIG. 1 and a partial broken away side view of the fluid pressure regulator embodiment referenced by number 11 as viewed in FIG. 1.

FIG. 3 shows a cross-sectional view of one embodiment of fluid coolant sensing means 12 that may be used in the control system of the invention. Sensing means 12 is in the form of an open-ended member connected at one end to a regulator 11 and at the opposite end to a chamber such as pipe 13 where the temperature of the coolant may be suitably sensed. Temperature responsive element 45 is secured at location 46 in chamber 13 at one end thereof and extends across chamber 13 through opening 47 through the wall of chamber 13 into cavity 44 of sensing means 12 and connects at the opposite end thereof of linking member 48 which is connected to moveable member 49 of regulator 11. Although not shown, opening 47 is preferably sealed in such a manner as to prevent coolant fluid leakage from chamber 13 from entering cavity 44. Element 45 is made of a material and has a configuration that enables it to expand and contract in response to respective increases and decreases in temperature of the engine coolant fluid flowing through chamber 13. The expansion and contraction of element 45 causes linking member 48 to move moveable member 49 in a direction responsive to the direction of movement of element 45. Thus element 45 is able to expand and contract to provide a temperature responsive output signal that is proportional to the change in the engine coolant fluid temperature which is able to proportionally move moveable member 49 by means of linking member 48 to proportionately regulate fluid pressure supply 10 conveyed to regulator 11 to provide the additional fluid pressure output signal 14 therefrom. The term "coolant fluid" as used herein includes both liquid and gaseous coolants such as air depending upon the particular type of engine to which the control system of the invention is applied. Element 45 is preferably a bimetallic or wax element such as are widely known in the art and may have any configuration suitable for a particular application. The embodiment of sensing means 12 shown in FIG. 3 may be calibrated by any suitable means such as, for example, by the selection of materials and configurations used for element 45 such that element 45 is able to remain entirely stationary at selected coolant fluid operating temperatures. Means for adjusting the position of linking member 48 or the use of other types of linking members or for adjusting the position of moveable member 49 with respect to element 45 may also be used for the calibration of sensing means 12. Sensing means 12 is not limited to the embodiment shown in FIG. 3 and may be any means such as a diaphragm or bellows or other element whose movement in response to a temperature change is able to be utilized by a fluid pressure regulator to regulate a fluid pressure signal therefrom that is proportionate to the temperature sensed.

FIG. 4 shows an example of one embodiment of an atmospheric pressure sensing means that may be used in the control system of the present invention. Sensing means 18 has an aneroid member 51 that is secured to bar 53 within a housing 50. Bar 53 extends through slot 54 in housing 50 and is able to be moved by any suitable means such as, for example, threaded nut (not shown) to enable aneroid member 51 to be positioned within housing 50. Aneroid 51 has a flexible member 52 therewith which is adapted to move in response to changes in the barometric pressure since the pressure on the side of member 52 closest to bar 53 is sealed at a given pressure, usually standard atmospheric pressure of 14.7 p.s.i. Force member 55 is secured at one end to member 52 and at the other end to moveable member 57 of regulator 17 by means of pin 56. Thus an increase in the atmospheric pressure will cause members 52, 55 and 57 to move inwardly towards aneroid 51 and a decrease in the atmospheric pressure will cause the members to move toward regulator 7. Although the use of atmospheric pressure in aneroid 51 is preferred, member 51 may be charged to any pressure standard desired within the limits of its capabilities provided member 52 is able to provide the movement desired in response to changes in the atmospheric pressure from the standard. As previously described, sensing means 18 may be calibrated by moving bar 53 which causes moveable member 57 to be positioned for a particular atmosphric pressure desired. Although a particular type of pressure sensing means 18 is shown in FIG. 4, such is for illustrative purposes only for any type of mechanism responsive to pressure changes and able to provide an output signal proportional to such changes that can be utilized by a fluid pressure regulator to regulate a fluid pressure supply thereto to provide a fluid pressure signal therefrom that is proportionate to the change in pressure is considered with the scope of the invention.

Although the invention has been described hereinabove with respect to the presently preferred embodiments, it will be understood by those skilled in the art that modifications and variations may be made within the scope of the invention, which is limited only by the following claims.

What is claimed is:

1. A fluid pressure control system for maintaining a desired idling speed of an internal combustion engine comprising;

fluid pressure supply means, idle speed fluid pressure actuator means, said means adapted to maintain the desired engine idling speed by movement of a force member thereof in response to a fluid pressure control signal received thereby, engine speed sensing means, said means adapted to monitor the rotational speed of the engine and having means associated therewith for converting changes in the engine rotational speed into an output signal proportional to the engine rotational speed that is conveyed to a fluid pressure regulation means that is connected to the fluid pressure supply means and adapted to regulate the fluid pressure supply conveyed thereto to provide a first fluid pressure signal, at least one fluid pressure signal in addition to said first fluid pressure signal, said pressure signal provided by at least one engine operating condition other than the rotational speed thereof that is desired for use in maintaining the idling speed of the engine having means associated therewith for converting said change into an output signal proportional to the condition monitored that is conveyed to a fluid pressure regulation means that is connected to the fluid pressure supply means and has means associated therewith for providing said additional fluid pressure signal;

integration means, said means adapted to receive said first and said at least one additional fluid pressure signal and having means associated therewith for combining said signals in the manner desired into a single integrated output signal that is conveyed to a fluid pressure regulation means connected to the fluid pressure supply means and to the idle speed fluid pressure actuator means and has means associated therewith for utilizing said signal to regulate the fluid pressure supply conveyed thereto to provide the fluid pressure control signal for controlling the idle speed fluid pressure actuator means, and at least one of said engine speed sensing means, said additional engine operating condition sensing means, said fluid pressure regulation means, said integration means, and said actuator means calibratable such that the fluid pressure control signal is able to maintain the desired engine idling speed in response to a change in the rotational speed of the engine.

2. A fluid pressure control system for maintaining a desired idling speed of an internal combustion engine comprising;

fluid pressure supply means, idle speed fluid pressure actuator means, said means adapted to maintain the engine idling speed by movement of a force member thereof in response to a fluid pressure control signal received thereby, integration means, said means adapted to receive a first and at least one additional fluid pressure input signal and having means associated therewith for combining said signals in the manner desired into a single integrated output signal that is conveyed to a fluid pressure regulation means connected to the fluid pressure supply means and to the idle speed fluid pressure actuator means and has means associated therewith for utilizing said signal to regulate the fluid pressure supply conveyed thereto to provide the fluid pressure control signal for controlling the idle speed fluid pressure actuator means, said first fluid pressure input signal to the integration means provided by an engine speed sensing means adapted to monitor the rotational speed of the engine and having means associated therewith for converting changes in the rotational speed monitored into an engine speed output signal proportional to the engine speed that is conveyed to a fluid pressure regulation means that is connected to the fluid pressure supply means and the integration means and has means associated therewith for utilizing said signal to regulate the fluid pressure supply conveyed thereto to provide the integration means first fluid pressure input signal, said additional fluid pressure input signals to the integrator provided by at least one engine operating condition sensing means that is adapted to monitor changes in an engine operating condition other than the rotational speed thereof that is desired for use in maintaining the idling speed of the engine and has means associated therewith for converting said change into an output signal proportional to the condition monitored that is conveyed to a fluid pressure regulation means that is connected to the fluid pressure supply means and the integration means and has means associated therewith for utilizing said signal to provide the integration means additional fluid pressure input signal, and at least one of said engine speed sensing means, said additional engine operating condition sensing means said integration means, said regulation means, and said actuator means calibratable such that in combination they are able to establish a desired engine idling speed for a particular engine rotational speed and additional engine operating conditions and to maintain the desired idling speed in response to a change in the pressure control signal arising from a change in the integrated output signal caused by a change in the first and additional fluid pressure input signals respectively arising from a change from the calibrated condition thereof sensed by the additional engine operating condition sensing means and from a change in the engine rotational speed from the calibrated condition thereof sensed by the engine speed sensing means.

3. The control system of claim 2 wherein the additional engine operating condition sensing means is a coolant fluid temperature sensing means, said means adapted to sense the engine coolant fluid temperature and having means associated therewith for converting changes in the temperature sensed into a temperature responsive output signal proportional to the coolant temperature that is conveyed to a fluid pressure regulation means connected to the fluid pressure supply means and to the integration means and having means associated therewith for utilizing said signal to to regulate the fluid pressure supply conveyed thereto to provide the integration means additional fluid pressure input signal.

4. The control system of claim 2 wherein the additional engine operating condition sensing means is an atmospheric pressure sensing means, said sensing means adapted to sense atmospheric pressure and having means associated therewith for converting changes in the atmospheric pressure from a calibrated condition thereof for a desired idling speed into a pressure responsive output signal, and said sensing means having a fluid pressure regulation means associated therewith that is connected to the fluid pressure supply means and to the integration means and adapted to utilize the pressure responsive output signal to regulate the fluid pressure supply connected thereto to provide the additional fluid pressure input signal to the integration means for the combining thereof with the first fluid pressure input signal to provide an integrated output signal that when regulated by the fluid pressure regulation means receiving the signal provides the fluid pressure control signal for maintaining the desired engine idling speed.

5. The control system of claim 1 or 2 wherein the engine speed output signal is provided by movement of a linking member of the engine speed sensing means, said biasing means comprising a support, a shaft rotatably mounted on the support, means for rotating the shaft at a speed proportional to the rotational speed of the engine, a centrifugal weight assembly secured to the shaft and adapted to rotate therewith and having at least one component thereof that is caused to move in one direction along the shaft in response to the effect of increased centrifugal force thereupon when the rotational speed of the shaft is increased and to move in an opposite direction along the shaft in response to the effect of decreased centrifugal force thereupon when the rotational speed of the shaft is decreased, said linking member connected to the coupling member and able to move a moveable member of the fluid pressure regulation means connected thereto in response to the movement of the coupling member along the shaft which movement is able to regulate the fluid pressure supply conveyed to the vacuum regulation means to provide the integration means first fluid pressure input signal, and said sensing means having means for the calibration thereof to enable the moveable member to be positioned so as to enable the moveable member to regulate the fluid pressure supply to provide the input fluid pressure signal for the particular idling speed desired.

6. The control system of claim 5 including resilient means supported by the centrifugal weight assembly and disposed against the coupling member in such a manner as to increasingly dampen the movement of the coupling member along the shaft when the rotational speed of the shaft is decreased and bias the coupling member along the shaft when the rotational speed of the shaft is increased.

7. The control system of claim 5 wherein the resilient means is a coiled spring.

8. The control system of claim 5 wherein the means for rotating the shaft is a flexible cable that is caused to rotate by means disposed at one end thereof connecting the cable to the point at which the engine rotational speed is monitored and having means disposed at the opposite end thereof for engaging with rotational means disposed on the shaft and causing the shaft to rotate at speed proportional to the engine rotational speed.

9. The control system of claim 8 wherein the rotational means disposed on the shaft is a gear and the means disposed to the opposite end of the cable is a gear, said gears adapted to engage with each other and rotate together to cause the shaft to rotate at a speed proportional to the engine rotational speed.

10. The control system of claim 8 wherein the flexible cable is disposed within an outer protective jacket that is secured against movement with respect to the support and is able to rotate therewithin to cause the shaft to rotate.

11. The control system of claim 5 wherein the support is an open-ended housing having a cavity therewithin communicating with the openings, said housing having a cap disposed over one opening having an open space therewithin that communicates with the housing opening, said cap having an opening therethrough for receiving the engine speed monitoring means into the open space for the engagement thereof with the rotational means disposed on the shaft and having means disposed within the open space for rotatably supporting the shaft in the housing cavity, and said cap threadingly engaged with the housing such that turning of the cap is able to calibrate the engine speed sensing means by moving the shaft and centrifugal weight assembly and coupling member upwardly and downwardly within the cavity which in turn moves the linking member upwardly and downwardly through the opposite opening of the housing and moves the moveable member of the fluid pressure regulation means connected thereto to the position desired to regulate the fluid pressure supply conveyed thereto to provide the first fluid pressure input signal required to establish the desired engine idling speed.

12. The control system of claim 3 wherein the temperature responsive output signal is provided by movement of a linking member of the coolant fluid temperature sensing means, said sensing means comprising a temperature responsive element that is able to sense the temperature of the coolant fluid and move in one direction when the temperature increases and in the opposite direction when the temperature decreases, said linking member connected to the temperature responsive element and able to move in response to the movement thereof and move a moveable member of the fluid pressure regulation means connected thereto which movement is able to regulate the fluid pressure supply to provide the integration means additional fluid pressure input signal, and said sensing means having means for the calibration thereof that enables the sensing member to move the moveable member in such a manner that the fluid pressure regulation means is able to regulate the fluid pressure supply to provide the additional fluid pressure input signal for the particular engine idling speed desired.

13. The control system of claim 12 wherein the temperature responsive element is a bimetallic element.

14. The control system of claim 12 wherein the coolant fluid sensing means is calibratable by means of the material from which the temperature responsive element is made such that by the use of a particular material the element is able to remain stationary for a particular coolant fluid temperature and move in the one direction when the temperature increases above the particular temperature and in the opposite direction when the temperature decreases below the particular temperature.

15. The control system of claim 12 wherein the coolant fluid sensing means is calibratable by means that enable the position of the moveable member to be adjusted such that the moveable member is able to regulate the fluid pressure supply to provide the additional input fluid pressure supply for the particular engine idling speed desired.

16. The control system of claim 4 wherein the pressure responsive output signal is provided by a linking member of the atmospheric pressure sensing means, said sensing means comprising a pressure tight chamber pressurized to a pressure equivalent to the atmospheric pressure selected for the idling speed desired, said chamber supported against movement with respect to the fluid pressure regulation means and having at least a portion thereof exposed to atmospheric pressure that has sufficient flexibility to enable the portion to move in response to a change in the atmospheric pressure, said linking member connected to the moveable portion and able to move a moveable member of the fluid pressure regulation means connected thereto which movement is able to regulate the fluid pressure supply to provide the additional fluid pressure input signal for a desired idling speed, and said sensing means having means for the calibration thereof that enables the sensing member to move the moveable member in such a manner that the fluid pressure regulation means is able to regulate the fluid pressure supply to provide the additional fluid pressure input signal for the particular engine idling speed desired.

17. A fluid pressure operated throttle control system for maintaining the idling speed of an internal combustion engine comprising:

means operable to provide a source of fluid pressure; means operable to provide a speed signal force output proportional to the engine speed;

speed regulator valve means having a control member connected to receive said speed signal force, said valve means having the inlet port thereof connected to said fluid pressure source and operable to provide a regulated fluid pressure speed signal at the outlet port thereof in response to changes in said speed signal force;

at least one additional sensing valve means having the inlet port thereof connected to said fluid pressure source, said valve means being operative in response to sensed changes in an engine operating condition other than the rotational speed thereof to provide a regulated fluid pressure signal at the output port thereof;

signal integrator valve means having a fluid pressure supply port connected to said fluid pressure source and a plurality of fluid pressure signal inlet ports and a fluid pressure outlet port with said speed signal applied to one of inlet ports and said additional engine condition signal applied to another of said inlet ports, said signal integrator means being operative to sum said speed signal and the additional signal and regulate said supply to provide an idle speed control signal representative of said sum and apply said idle speed signal to said outlet port; and actuator means including fluid pressure responsive means and a force output member associated therewith, said actuator means having an inlet port receiving said idle speed signal therein, with said force output member connected to the engine throttle, said pressure responsive means being operable in response to changes in said idle speed signal to vary the force on said output member for effecting the idle control of the engine throttle.

18. The control system defined in claim 17 wherein the additional sensing valve means is an altitude compensating valve means having an inlet port thereof connected to said fluid pressure source and a fluid pressure outlet port, said valve means being operative to regulate said supply pressure in response to changes in atmospheric pressure and provide a resultant altitude compensating fluid pressure signal at said outlet port, wherein said altitude compensating signal is applied to still another of said integrating means inlet ports whereby said integrating means sums said engine speed signal and said altitude compensating signal to provide the idle speed control signal.

19. The control system defined in claim 17 wherein the additional sensing valve means is a temperature sensing valve means having the inlet port thereof connected to said fluid pressure source, said valve means being operative in response to sensed changes in the temperature of the engine coolant to provide a regulated fluid pressure temperature signal at the output port thereof.

* * * * *